US011121514B1

(12) United States Patent
Roberts et al.

(10) Patent No.: US 11,121,514 B1
(45) Date of Patent: Sep. 14, 2021

(54) FLANGE MOUNT COAXIAL CONNECTOR SYSTEM

(71) Applicant: ANRITSU COMPANY, Morgan Hill, CA (US)

(72) Inventors: Thomas H Roberts, Morgan Hill, CA (US); Jon Martens, San Jose, CA (US)

(73) Assignee: ANRITSU COMPANY, Morgan Hill, CA (US)

( * ) Notice: Subject to any disclaimer, the term of this patent is extended or adjusted under 35 U.S.C. 154(b) by 0 days.

(21) Appl. No.: 16/573,870

(22) Filed: Sep. 17, 2019

Related U.S. Application Data

(60) Provisional application No. 62/732,252, filed on Sep. 17, 2018.

(51) Int. Cl.

| | |
|---|---|
| ***H01R 13/631*** | (2006.01) |
| ***H01R 31/06*** | (2006.01) |
| ***H01P 5/02*** | (2006.01) |
| ***H01R 13/03*** | (2006.01) |
| ***H01P 3/06*** | (2006.01) |

(Continued)

(52) U.S. Cl.
CPC ..... *H01R 31/06* (2013.01); *H01P 3/06* (2013.01); *H01P 5/02* (2013.01); *H01R 13/03* (2013.01); *H01R 13/631* (2013.01); *H01R 13/646* (2013.01); *H01P 1/045* (2013.01); *H01R 13/2414* (2013.01); *H01R 13/6315* (2013.01); *H01R 13/6395* (2013.01); *H01R 13/6473* (2013.01); *H01R 24/40* (2013.01); *H01R 24/52* (2013.01); *H01R 24/542* (2013.01)

(58) Field of Classification Search
CPC .... H01R 13/2414; H01R 24/40; H01R 24/52; H01R 24/542; H01R 13/6473; H01R 13/6315; H01R 13/6395; H01R 9/0515; H01P 1/045; Y10S 439/933
See application file for complete search history.

(56) References Cited

U.S. PATENT DOCUMENTS 4,426,127 A * 1/1984 Kubota ..... H01R 24/40 439/607.17
4,672,342 A * 6/1987 Gartzke ..... H01R 24/542 333/260

(Continued)

OTHER PUBLICATIONS

Akmal, M. et al., "An Enhanced Modulated Waveform Measurement System for the Robust Characterization of Microwave Devices under Modulated Excitation", Proceedings of the 6th European Microwave Integrated Circuits Conference, Oct. 10-11, 2011, Manchester, UK, © 2011, pp. 180-183.

(Continued)

*Primary Examiner* — Tho D Ta
(74) *Attorney, Agent, or Firm* — Tucker Ellis LLP

(57) ABSTRACT

A coaxial connector system is provided suitable for connection of high-frequency components such as high-band test modules and probes. The coaxial connector system uses a flange mating element aligned using precession guiding pins. A center conductor assembly is captive in a center bore of the flange and includes elastomer contacts which are compressed against the coaxial center conductors of the high=frequency components. The flange mount coaxial connector system provides a robust, mechanically stable mount which minimizes electrical performance changes with mechanical torque as compared to screw on connectors.

20 Claims, 7 Drawing Sheets

(51) Int. Cl.

| | |
|---|---|
| ***H01R 13/646*** | (2011.01) |
| *H01R 13/639* | (2006.01) |
| *H01R 24/54* | (2011.01) |
| *H01P 1/04* | (2006.01) |
| *H01R 24/52* | (2011.01) |
| *H01R 13/6473* | (2011.01) |
| *H01R 13/24* | (2006.01) |
| *H01R 24/40* | (2011.01) |

(56) References Cited

U.S. PATENT DOCUMENTS 5,134,364 A * 7/1992 Karpman ..... G01R 1/06711 324/72.5
5,141,444 A * 8/1992 Redmond ..... H01R 13/15 439/59
5,801,525 A 9/1998 Oldfield
5,812,039 A 9/1998 Oldfield
5,909,192 A 6/1999 Finch
5,977,779 A 11/1999 Bradley
6,049,212 A 4/2000 Oldfield
6,291,984 B1 9/2001 Wong
6,316,945 B1 11/2001 Kapetanic
6,331,769 B1 12/2001 Wong
6,496,353 B1 12/2002 Chio
6,504,449 B2 1/2003 Constantine
6,509,821 B2 1/2003 Oldfield
6,525,631 B1 2/2003 Oldfield
6,529,844 B1 3/2003 Kapetanic
6,548,999 B2 4/2003 Wong
6,650,123 B2 11/2003 Martens
6,665,628 B2 12/2003 Martens
6,670,796 B2 12/2003 Mori
6,680,679 B2 1/2004 Stickle
6,700,366 B2 3/2004 Truesdale
6,700,531 B2 3/2004 Abou-Jaoude
6,714,898 B1 3/2004 Kapetanic
6,766,262 B2 7/2004 Martens
6,832,170 B2 12/2004 Martens
6,839,030 B2 1/2005 Noujeim
6,882,160 B2 4/2005 Martens
6,888,342 B2 5/2005 Bradley
6,894,581 B2 5/2005 Noujeim
6,917,892 B2 7/2005 Bradley
6,928,373 B2 8/2005 Martens
6,943,563 B2 9/2005 Martens
7,002,517 B2 2/2006 Noujeim
7,011,529 B2 3/2006 Oldfield
7,016,024 B2 3/2006 Bridge
7,019,510 B1 3/2006 Bradley
7,054,776 B2 5/2006 Bradley
7,068,046 B2 6/2006 Martens
7,088,111 B2 8/2006 Noujeim
7,108,527 B2 9/2006 Oldfield
7,126,347 B1 10/2006 Bradley
7,173,423 B2 2/2007 Buchwald
7,284,141 B2 10/2007 Stickle
7,304,469 B1 12/2007 Bradley
7,307,493 B2 12/2007 Feldman
7,509,107 B2 3/2009 Bradley
7,511,577 B2 3/2009 Bradley
7,521,939 B2 4/2009 Bradley
7,545,151 B2 6/2009 Martens
7,683,602 B2 3/2010 Bradley
7,683,633 B2 3/2010 Noujeim
7,705,582 B2 4/2010 Noujeim
7,746,052 B2 6/2010 Noujeim
7,764,141 B2 7/2010 Noujeim
7,872,467 B2 1/2011 Bradley
7,924,024 B2 4/2011 Martens
7,957,462 B2 6/2011 Aboujaoude
7,983,668 B2 7/2011 Tiernan
8,027,390 B2 9/2011 Noujeim
8,058,880 B2 11/2011 Bradley
8,145,166 B2 3/2012 Barber
8,156,167 B2 4/2012 Bradley
8,159,208 B2 4/2012 Brown
8,169,993 B2 5/2012 Huang
8,185,078 B2 5/2012 Martens
8,278,944 B1 10/2012 Noujeim
8,294,469 B2 10/2012 Bradley
8,305,115 B2 11/2012 Bradley
8,306,134 B2 11/2012 Martens
8,410,786 B1 4/2013 Bradley
8,417,189 B2 4/2013 Noujeim
8,457,187 B1 6/2013 Aboujaoude
8,493,111 B1 7/2013 Bradley
8,498,582 B1 7/2013 Bradley
8,538,350 B2 9/2013 Varjonen
8,593,158 B1 11/2013 Bradley
8,629,671 B1 1/2014 Bradley
8,630,591 B1 1/2014 Martens
8,666,322 B1 3/2014 Bradley
8,718,586 B2 5/2014 Martens
8,760,148 B1 6/2014 Bradley
8,816,672 B1 8/2014 Bradley
8,816,673 B1 8/2014 Barber
8,884,664 B1 11/2014 Bradley
8,903,149 B1 12/2014 Noujeim
8,903,324 B1 12/2014 Bradley
8,942,109 B2 1/2015 Dorenbosch
9,103,856 B2 8/2015 Brown
9,103,873 B1 8/2015 Martens
9,153,890 B2 10/2015 Warwick
9,176,174 B1 11/2015 Bradley
9,176,180 B1 11/2015 Bradley
9,210,598 B1 12/2015 Bradley
9,239,371 B1 1/2016 Bradley
9,287,604 B1 3/2016 Noujeim
9,331,633 B1 5/2016 Robertson
9,337,941 B2 5/2016 Emerson
9,366,707 B1 6/2016 Bradley
9,455,792 B1 9/2016 Truesdale
9,560,537 B1 1/2017 Lundquist
9,571,142 B2 2/2017 Huang
9,588,212 B1 3/2017 Bradley
9,594,370 B1 3/2017 Bradley
9,606,212 B1 3/2017 Martens
9,680,245 B2 6/2017 Warwick
9,685,717 B2 6/2017 Warwick
9,696,403 B1 7/2017 Elder-Groebe
9,733,289 B1 8/2017 Bradley
9,753,071 B1 9/2017 Martens
9,768,892 B1 9/2017 Bradley
9,860,054 B1 1/2018 Bradley
9,964,585 B1 5/2018 Bradley
9,967,085 B1 5/2018 Bradley
9,977,068 B1 5/2018 Bradley
10,003,453 B1 6/2018 Bradley
10,006,952 B1 6/2018 Bradley
10,064,317 B1 8/2018 Bradley
10,116,432 B1 10/2018 Bradley
2006/0046564 A1* 3/2006 Stanford ..... H01R 24/564 439/578
2007/0227757 A1* 10/2007 Moore ..... E21B 33/0385 174/92
2008/0072422 A1* 3/2008 Levante ..... H05K 3/326 29/852

OTHER PUBLICATIONS

Cunha, Telmo R. et al., "Characterizing Power Amplifier Static AM/PM with Spectrum Analyzer Measurements", IEEE © 2014, 4 pages.

Fager, Christian et al., "Prediction of Smart Antenna Transmitter Characteristics Using a New Behavioral Modeling Approach" IEEE® 2014, 4 pages.

Fager, Christian et al., "Analysis of Nonlinear Distortion in Phased Array Transmitters" 2017 International Workshop on Integrated Nonlinear Microwave and Millmetre-Wave Circuits (INMMiC), Apr. 20-21, 2017, Graz, Austria, 4 pages.

(56) References Cited

OTHER PUBLICATIONS

Martens, J. et al., "Towards Faster, Swept, Time-Coherent Transient Network Analyzer Measurements" 86th ARFTG Conf. Dig., Dec. 2015, 4 pages.
Martens, J., "Match correction and linearity effects on wide-bandwidth modulated AM-AM and AM-PM measurements" 2016 EuMW Conf. Dig., Oct. 2016, 4 pages.
Nopchinda, Dhecha et al., "Emulation of Array Coupling Influence on RF Power Amplifiers in a Measurement Setup", IEEE © 2016, 4 pages.
Pedro, Jose Carlos et al., "On the Use of Multitone Techniques for Assessing RF Components' Intermodulation Distortion", IEEE Transactions on Microwave Theory and Techniques, vol. 47, No. 12, Dec. 1999, pp. 2393-2402.
Ribeiro, Diogo C. et al., "D-Parameters: A Novel Framework for Characterization and Behavorial Modeling of Mixed-Signal Systems", IEEE Transactions on Microwave Theory and Techniques, vol. 63, No. 10, Oct. 2015, pp. 3277-3287.
Roblin, Patrick, "Nonlinear RF Circuits and Nonlinear Vector Network Analyzers; Interactive Measurement and Design Techniques", The Cambridge RF and Microwave Engineering Series, Cambridge University Press © 2011, entire book.
Rusek, Fredrik et al., "Scaling Up MIMO; Opportunities and challenges with very large arrays", IEEE Signal Processing Magazine, Jan. 2013, pp. 40-60.
Senic, Damir et al., "Estimating and Reducing Uncertainty in Reverberation-Chamber Characterization at Millimeter-Wave Frequencies", IEEE Transactions on Antennas and Propagation, vol. 64, No. 7, Jul. 2016, pp. 3130-3140.
Senic, Damir et al., "Radiated Power Based on Wave Parameters at Millimeter-wave Frequencies for Integrated Wireless Devices", IEEE © 2016, 4 pages.

* cited by examiner

FLANGE MOUNT COAXIAL CONNECTOR SYSTEM

PRIORITY CLAIM

The present application claims priority to U.S. Provisional Application 62/732,252 entitled FLANGE MOUNT COAXIAL CONNECTOR SYSTEM filed Sep. 17, 2018 which application is incorporated herein by reference in its entirety.

TECHNICAL FIELD

The present invention relates generally to coaxial connectors.

BACKGROUND

Traditional high frequency coaxial connector designs similar to those referenced in IEEE-STD-287 utilize a threaded outer conductor and pin/socket center conductor design. The threaded outer conductor allows two connectors to be securely mated together and slotted contacts allow a reliable and repeatable connection. Higher frequency coaxial connectors must reduce in size to prevent higher order modes from propagating. However, when machining smaller size connectors, features such as slotted contacts cannot be machined and are impractical. Furthermore, reducing the size of threaded outer conductors 1) enforces a minimum connector length increasing the mechanical torque sensitivity on the connector system and 2) reduces the connectors overall strength.

Alternative coaxial connector designs use conductive elastomers on the coaxial outer conductor to electrically connect signal ground as described in U.S. Pat. No. 9,685,717. At the contact location, it is desired to have a constant impedance over the structures length and at the point where the mating connector is making contact with the conductive elastomers. However, with this approach, it is difficult to maintain a constant coaxial impedance by the presence of the mechanical stops and ground elastomers mounted on the coaxial cable's dielectric and outer conductor edge, respectively.

Other alternative coaxial connector assemblies have been used that require metal retaining tabs (attached around the pin) to be inserted in a catch formed into a housing as described in U.S. Pat. Nos. 9,680,245 and 9,153,890. However, with these attributes, the structure cannot support high frequencies since the connector's impedance changes over its length (due to metal tab and change in housing diameter) causing significant signal reflections.

Accordingly it would be desirable to provide new high frequency coaxial connector designs which overcome the problems observed in the prior art, In particular it would be desirable to provide coaxial connector designs which can be manufactured at small size with high strength, have low torque sensitivity, have constant and repeatable coaxial impedance, and which support high frequencies.

Accordingly it is an object of the present invention to provide new high frequency coaxial connector designs which overcome the problems observed in the prior art, In particular the present invention provides a flange-mount coaxial connector system which can be manufactured at small size with high strength, have low torque sensitivity, have constant and repeatable coaxial impedance, and which support high frequencies.

These and other objects and advantages of the present invention will become apparent to those skilled in the art from the following description of the various embodiments, when read in light of the accompanying drawings.

DETAILED DESCRIPTION

The following description is of the best modes presently contemplated for practicing various embodiments of the present invention. The description is not to be taken in a limiting sense but is made merely for the purpose of describing the general principles of the invention. The scope of the invention should be ascertained with reference to the claims. In the description of the invention that follows, like numerals or reference designators will be used to refer to like parts or elements throughout.

In the following description, numerous specific details are set forth to provide a thorough description of the invention. However, it will be apparent to those skilled in the art that the invention may be practiced without these specific details. In other instances, well-known features have not been described in detail so as not to obscure the invention.

In accordance with an embodiment, a flange mount, frequency and mechanically scalable, DC coupled, millimeter wave coaxial broadband transmission line structure is provided which easily adapts from its native coaxial structure to waveguide. This connector system can be used, for example, in a VNA system such as the Broadband ME7838 VNA system offered by ANRITSU®.

In accordance with an embodiment, the coaxial connector system uses a flange mating system and a conducting elastomer center conductor contact. Precision guiding pins and screws axially align and secure the mating flanges together. The coaxial center conductors are electrically connected to each other through an electrically conductive, compressed elastomer. Additional flanges can be connected against the elastomer to transition to band limited waveguide interfaces.

In accordance with an embodiment, a connector system comprises a cylindrical conductive elastomer to electrically connect two center conductors of the same diameter to form a continuous impedance TEM transmission line structure with minimum signal reflection.

In accordance with an embodiment, a coaxial connector system using a precision pin guided flange mount mating interface ensuring precise axial alignment between connectors and ensuring mode free operation.

In accordance with an embodiment, a connector system comprises mating flanges which provide a continuous ground between both a coaxial-to-coaxial connection, and a coaxial-to-waveguide connection.

In accordance with an embodiment, a coaxial connector flange system allows attachment of single piece, waveguide transition flanges to convert from native coaxial transmission line structure to band-limited waveguide interfaces.

In accordance with an embodiment, the elastomer coaxial assembly is a removable adapter and not permanently mounted to the system. The adapter can be replaced as necessary without impact to system.

Figure 1A:
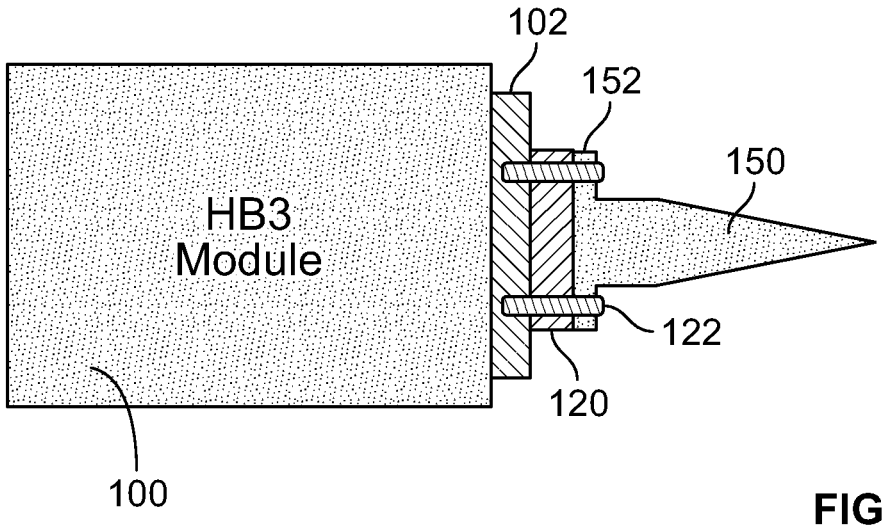
FIG. 1A illustrates a top view and FIG. 1B illustrates a side view of a connection of a coaxial interface with a probe, in accordance with an embodiment.
Figure 1B:
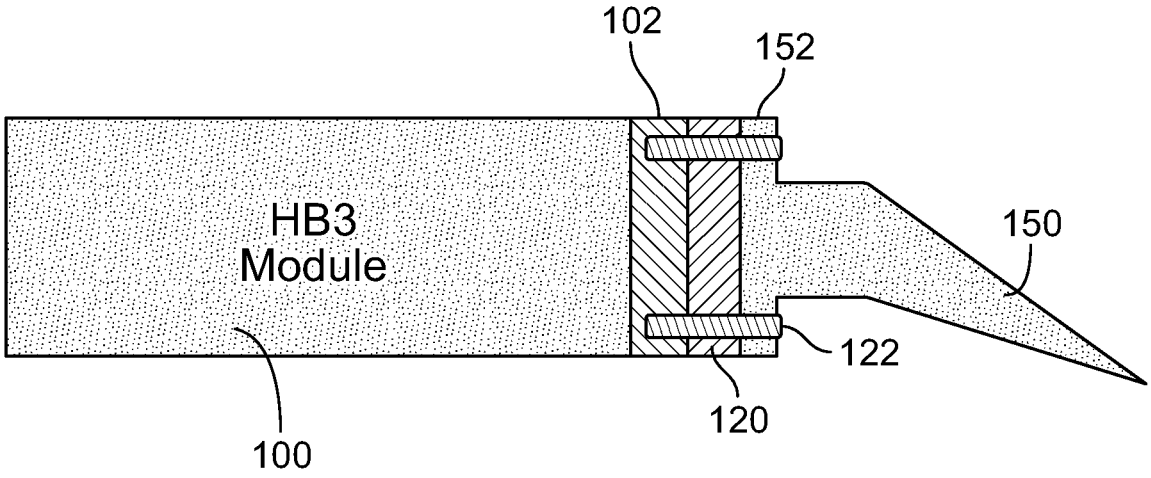

FIG. 1A illustrates top view and FIG. 1B illustrate a side vide of a connection of a coaxial interface with a probe, in accordance with an embodiment. In particular, an HB3 module 100 is shown with a flange mount UT-20 coaxial interface 102 connected with a 220 GHz flange mount probe 150 with a UT-20 coaxial interface 152 via a flange mount connector saver 120 and four alignment dowel pins/guide pins 122. The HB3 module is a high-band test module which can be connected to a vector network analyzer (VNA). The flange mount connector saver connects the HB3 module 100 to the 220 GHz probe 150. The HB3 module 100 and the 220 GHz probe 150 have mating interfaces (see FIGS. 6A-6C).

Figure 2A:
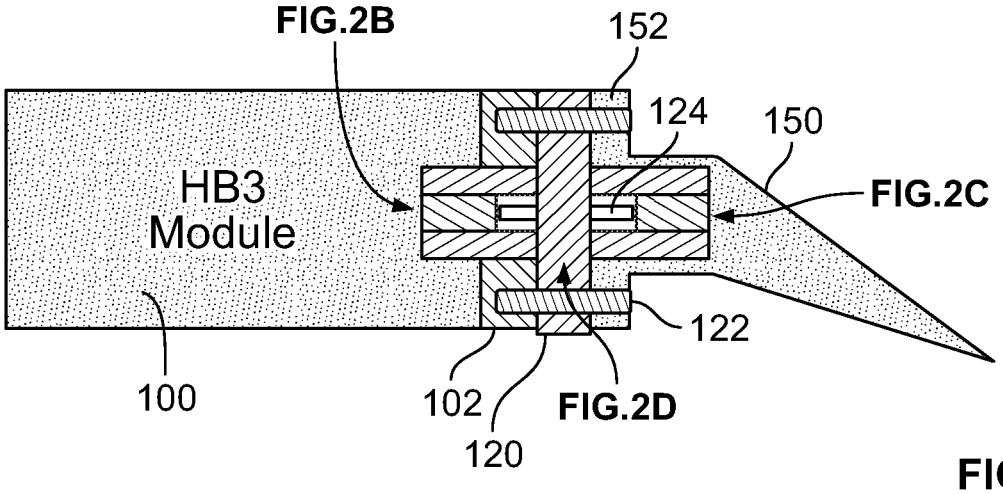
FIGS. 2A-2D illustrates the side view of the connection of FIGS. 1A and 1B along with additional details of the interfaces.

FIGS. 2A-2D illustrate the side view of the connection of FIGS. 1A and 1B along with additional details of the interfaces. FIG. 2A shows an overview of the connection of a coaxial interface 102 of the HB3 module with a coaxial interface 152 of the probe 150. In this specific implementation, the flange mount UT-20 coaxial interface 102 is permanently mounted to the HB3 module 100. The probe 150 is a 220 GHz flange mount probe with a UT-20 coaxial interface 152.

Figure 2B:
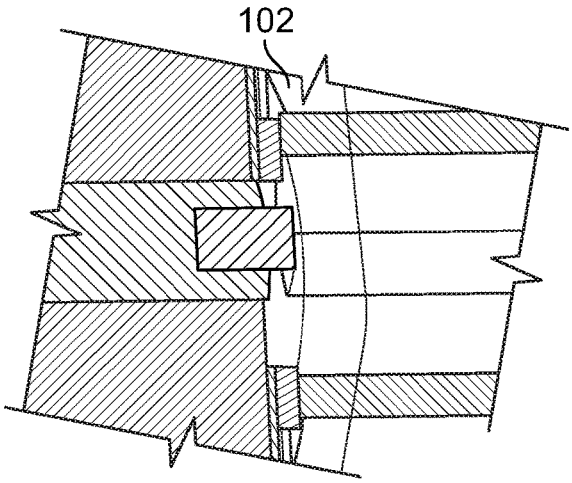
Figure 2C:
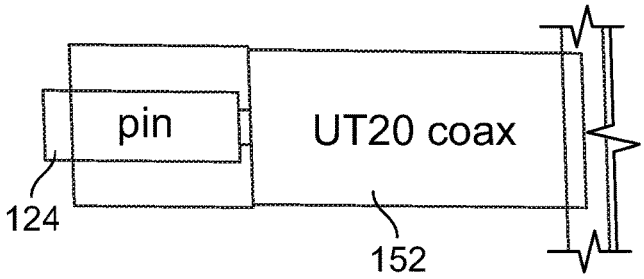
Figure 2D:
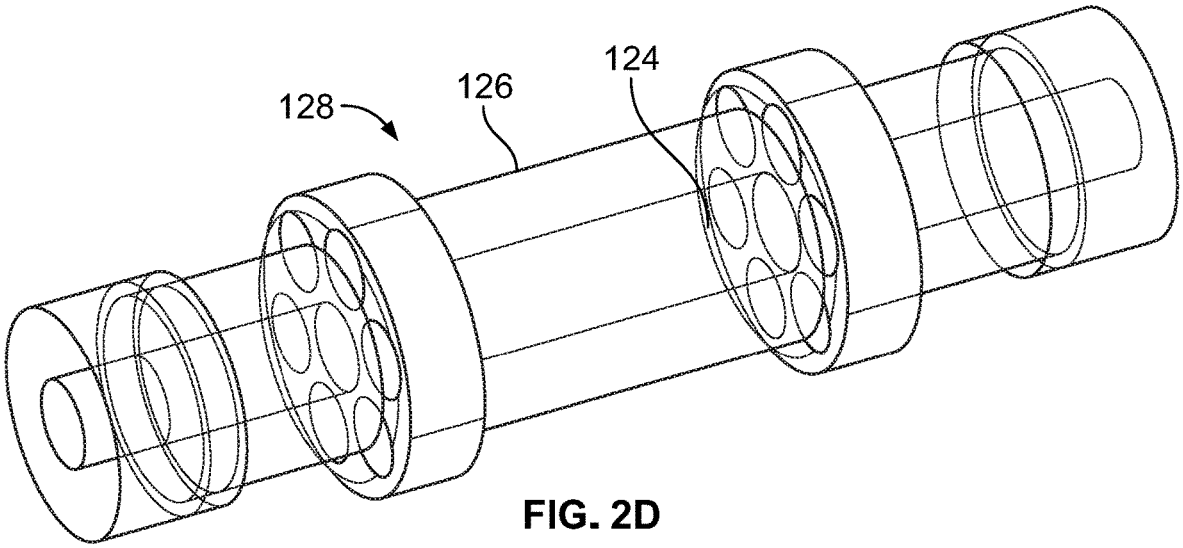

FIG. 2B shows detail of the module side of the connection. The Flange mount UT-20 coaxial interface 102 is permanently mounted to the HB3 module 100. The detail show the ~20 dB RL to 220 GHz connection. FIG. 2C shows detail of the probe side of the connection. FIG. 2B shows the UT20 coax connection of the probe mating with a conductive pin 124 within the flange mount connector saver 120. FIG. 2D shows detail within the flange mount connector saver 120 showing the pin 124 within a bore 126 of the flange 128.

In the embodiment of FIGS. 1A, 1B and 2A-2D, the flange mount coaxial connection interface provides a number of benefits. For example, there is no mating interface wear due to rotating outer and center conductors against mating connector parts. The embodiment provides precise axial alignment of mating interfaces using four precision alignment guide pins 120. The connection interface is mechanically rugged. As further illustrated, the flange parts are physically short, easy to machine and hold dimensional tolerances. There is no center conductor slotting or forming and no heat treating of center and outer conductors that is required. The pin/socket construction eliminates pin gap issues, insertion/withdraw force issues and connector manufacturing issues. Accordingly the connector is easier to manufacture and more effective to use the prior connector systems.

Figure 3A:
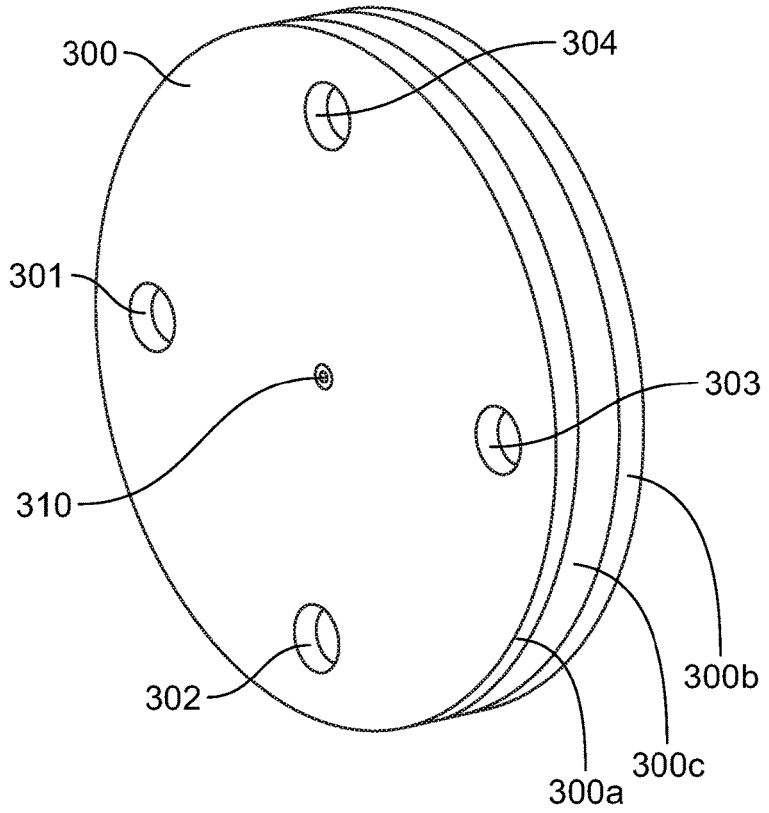
FIGS. 3A-3E illustrate a flange mount coax connector saver/adapter, in accordance with an embodiment.

FIGS. 3A-3E illustrate a flange mount coax connector saver/adapter and its components, in accordance with an embodiment. FIG. 3A shows the main flange 300. The connector flange includes three flanges epoxied together to hold the assembly in place. Total flange thickness is 2.0 mm. The outer flange layers 300*a*, 300*b* are 0.55 mm thick and the inner flange layer 300*c* is 0.9 mm thick. The flange has four peripheral bores 301, 302, 303, 304 which receive and register the four precision alignment guide pins 120. A central bore 310 holds a center conductor assembly shown in FIGS. 3B-3E.

Figure 3B:
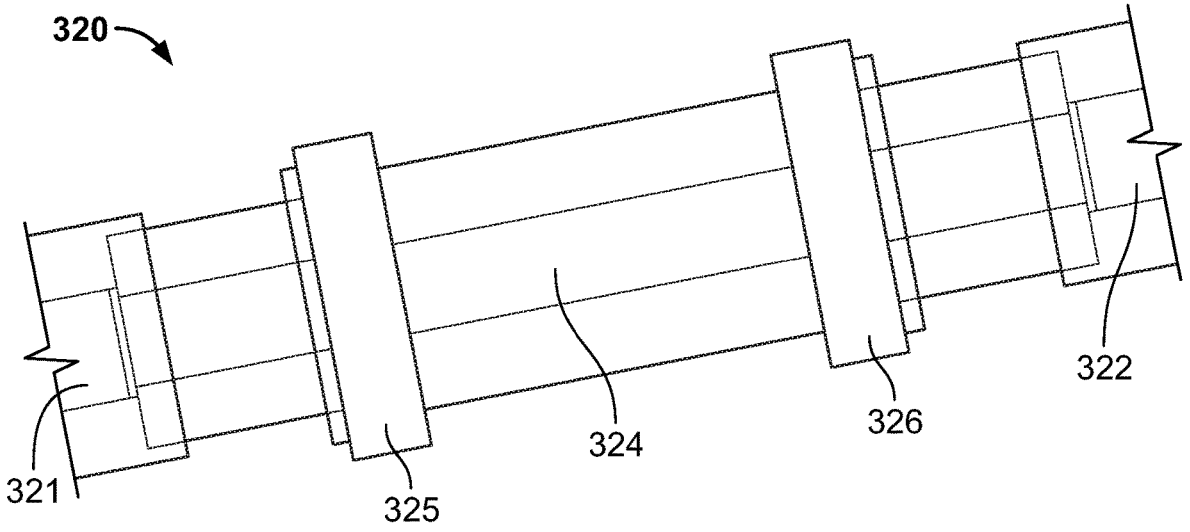

FIG. 3B shows a view of the center conductor assembly 320 which is positioned within the central bore 310 of flange 300. The center conductor assembly 320 include includes an elastomer contact 321, 322 on each end of center conductor 324, and two annular polyimide beads 325, 326, each 8 mils thick. In an embodiment the beads are made from DuPont™ Vesper) Polyimide which is an extremely high temperature, creep resistant plastic material. However other polyimides or plastic have appropriate dimensional stability may also be used. The elastomer contacts 321, 322 are adapted to contact coaxial connector pins in a compliant manner and thereby provide a reliable signal connection between the coaxial connector pin and the central conductor 324.

The center conductor assembly with the single, machined center conductor 324 provides a fully captivated center conductor assembly. The two Polyimide beads 325, 326 capture and position the center conductor in the center of the central bore 310 of the flange 300 while ensuring that the central conductor is electrically isolated from flange 300.

Figure 3C:
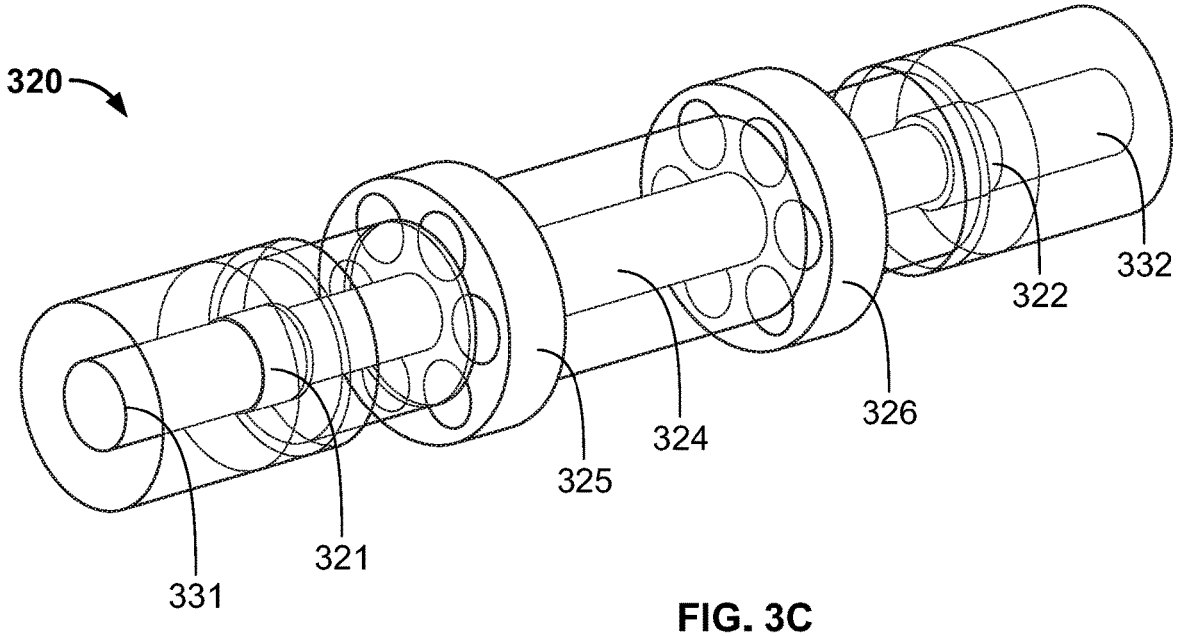

FIG. 3C shows another view of the center conductor assembly 320 which is positioned within the central bore 310 of flange 300. The center conductor assembly 320 include includes an elastomer contacts 321, 322 on each end of center conductor 324, and two Polyimide beads 325, 326, each 8 mils thick. The elastomer contacts 321, 322 are adapted to contact coaxial connector pins 331, 332 in a compliant manner and thereby provide a reliable signal connection between the coaxial connector pin and the central conductor 324. Note that coaxial connector pins 331, 332 are not part of the center conductor assembly, rather they are an element of the coax of interfaces of the UT-20 coaxial interface 102 of the HB3 module 100 and UT20 coax interface 152 of the probe 150 respectively. The center conductor assembly with the single, machined center conductor 324 provides a fully captivated center conductor assembly which pass high frequency signals between the coaxial connector pins 331, 332. The two Polyimide beads 325, 326 capture and position the center conductor in the center of the central bore 310 of the flange 300 while ensuring that the central conductor is electrically isolated from flange 300.

Figure 3D:
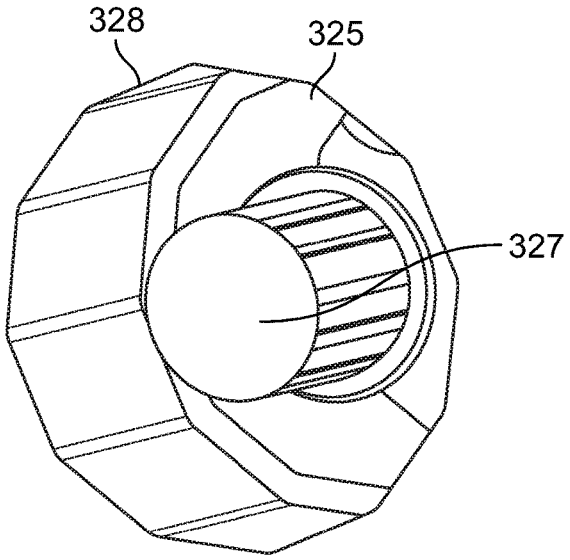
Figure 3E:
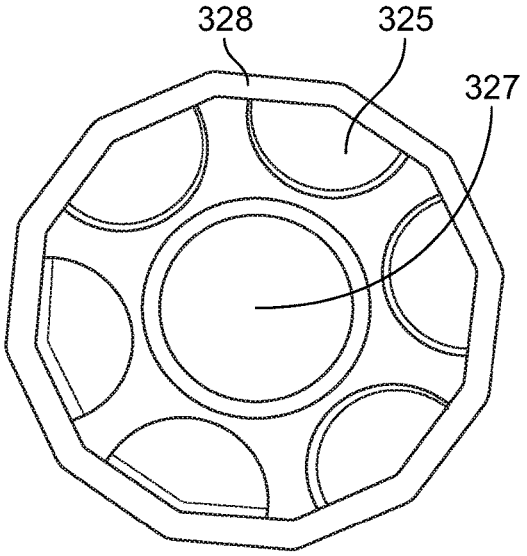

FIGS. 3D and 3E show different views of Polyimide beads. The Polyimide bead 325, 326 have a central bore 327 sized to receive and hold the conductor 324. The exterior perimeter 328 of the Polyimide bead is sized to engage the wall of the central bore 310 of the flange 300 thereby capturing and centralizing the conductor 324 within the central bore 310.

Figure 4A:
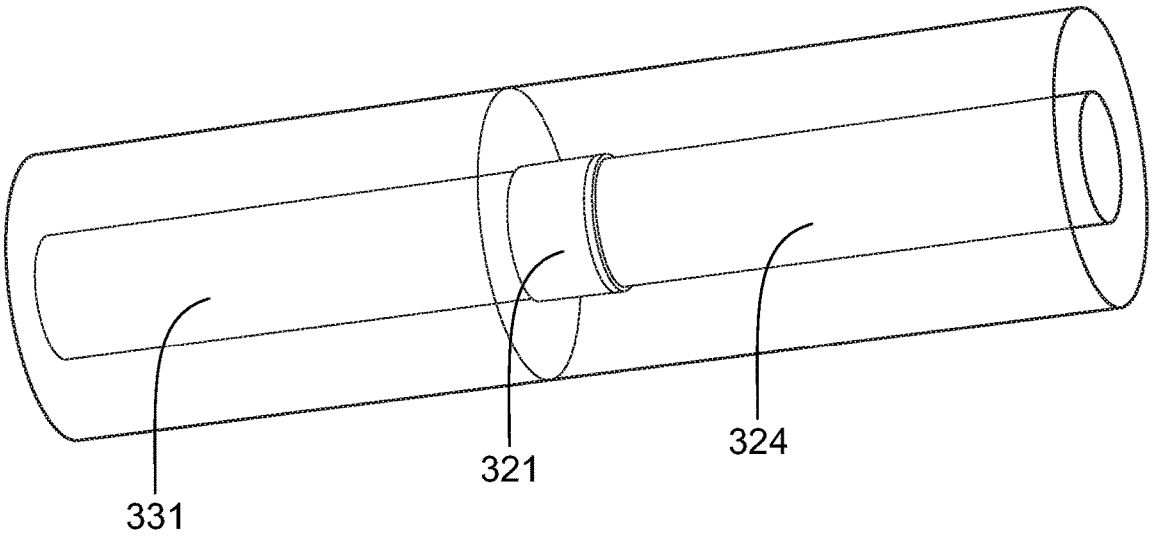
FIGS. 4A and 4B illustrates a coax to interface contact, with and without interface offset, in accordance with an embodiment.
Figure 4B:
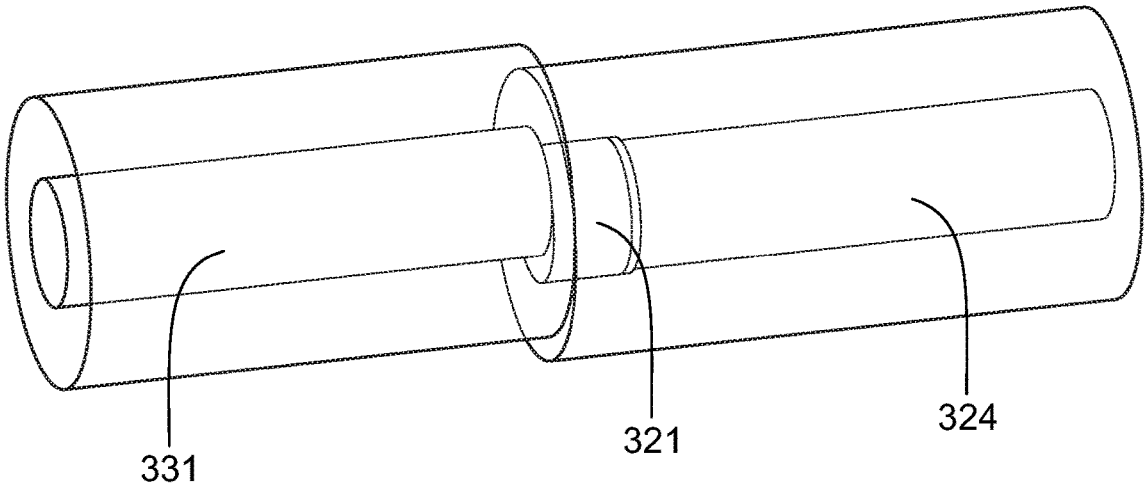

The coaxial center conductors are electrically connected to each other through an electrically conductive, compressed elastomer. FIGS. 4A and 4B illustrates details of a 0.6 mm coax pin 331 to elastomer contact 321. The contact 321 is made of elastomer. The elastomer provides less than 5 g force at 30% compression (~3 mils compressed). The elastomer has a bulk conductivity of 20,000 [S/m]. When two flanges are fastened together, the elastomer is compressed to a precise percentage of its uncompressed length. Compressing the elastomer increases its diameter equal to the diameter of the center conductor producing a constant impedance over its length. The elastomer contact is in a 30% compressed state that give approximately 50 ohm impedance for 0.6 mm coax to the center conductor 324. This connection tolerant of some mis-registration of the coax pin 331 and elastomer contact 321. Suitable elastomer contacts are available under the trade name INVISIPIN® from R&D Interconnect Solutions of Allentown, Pa.

Figure 5:
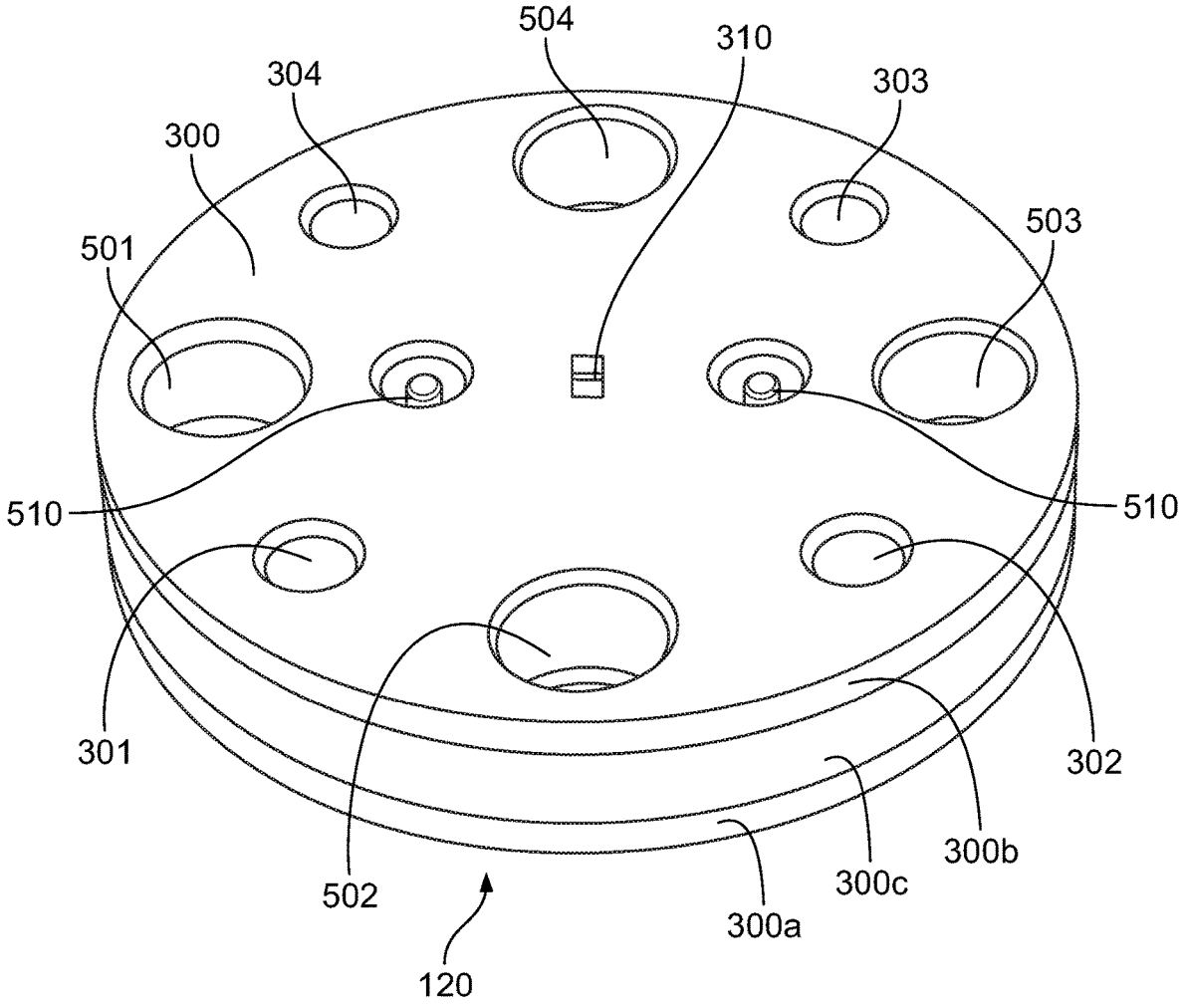
FIG. 5 shows a flange mount coax connector saver/adapter, in accordance with an embodiment.

FIG. 5 shows an embodiment of the flange mount connector saver 120 including main flange 300 comprised of outer flange layers 300*a*, 300*b* and the inner flange layer 300*c* secured together with epoxy. The flange has four peripheral bores 301, 302, 303, 304 which receive and register the four precision alignment guide pins 120. A central bore 310 holds the center conductor assembly shown in FIGS. 3B-3E. Additional bores 501, 502, 503, 504 are provided such that machine screws can pass through the flange mount connector saver 120 in order to mount the probe to the HB3 module.

During assembly, part of the center connector is honed off using a fixture. The first Polyimide bead is slid over center conductor. The center conductor and bead is inserted into the middle flange. The bead seats in a counter bore of middle flange. The second bead is then slid over center conductor on the other side of the middle flange. Again, the bead seats in a counter bore of middle flange. The middle flange, center conductor and beads are placed in in a compression fixture. The outer flanges are connected to the middle flange using dowel pins to align the flange layers with each other. The elastomer pads are secured to the ends of the center conductor using silver epoxy. Four short 4-40 screws and nuts are used to secure the three flanges together. Epoxy is applied around the outer rim and interior holes 510 to secure the three flange layers together. Once the epoxy has cured the connector is complete and ready for use.

Figure 6A:
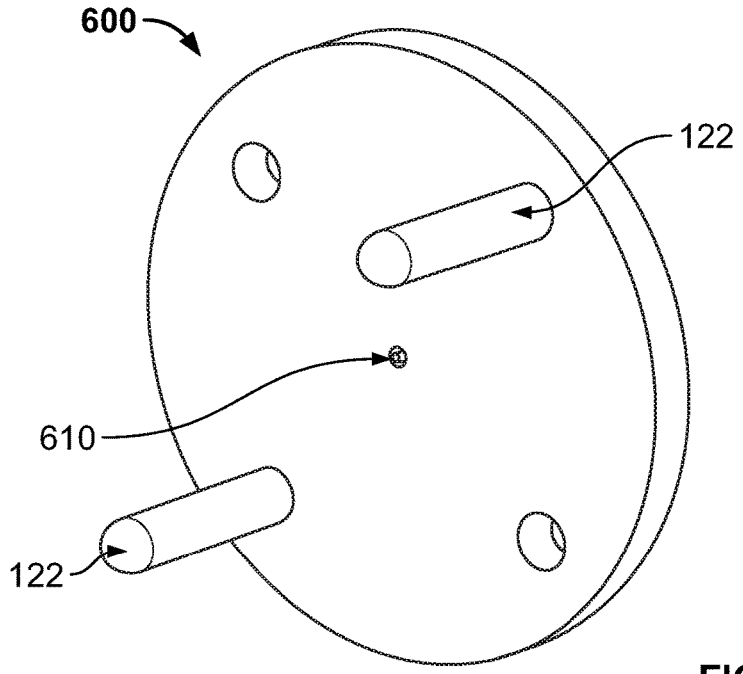
FIGS. 6A-6C show views of the flange mount coaxial connection interface 600 in accordance with an embodiment.
Figure 6B:
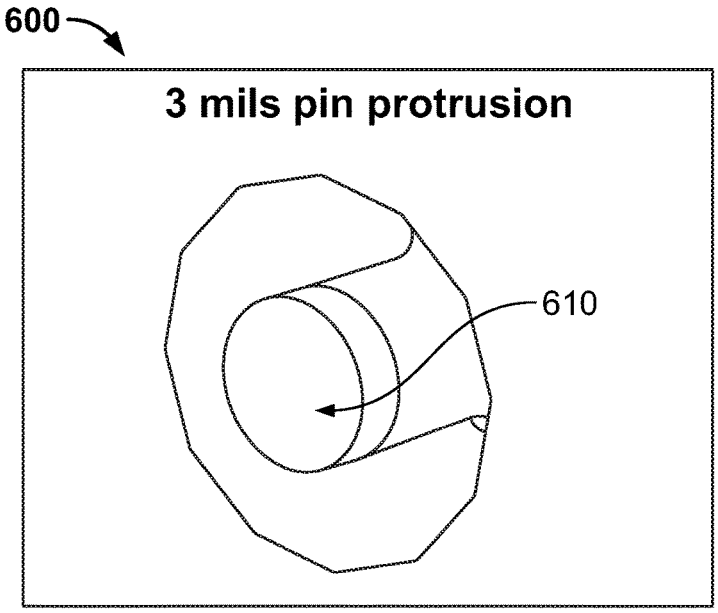
Figure 6C:
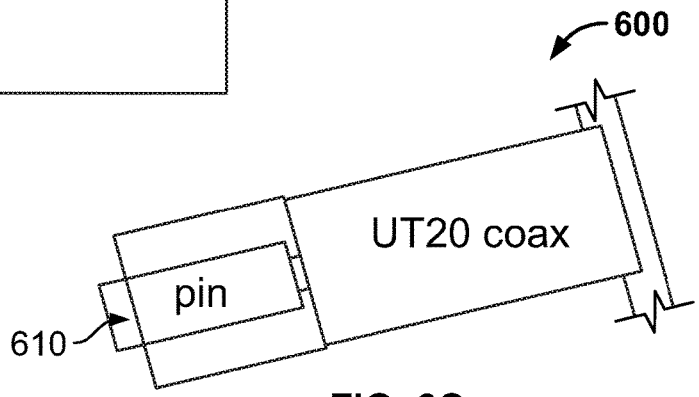

FIGS. 6A-6C show views of the UT-20 flange mount coaxial connection interface 600. This interface is provided on the probe and HB3 module to mate with the flange mount connector saver 120. As shown, each flange mount coaxial connection interface 600 includes two precision alignment guide pins 122. Two interface engage one either side of the flange mount connector saver 120 for four total pins. The flange mount coaxial connection interface 600 has a center pin which 610 which protrudes 3 mils from above the surface of the interface (see detail in FIG. 6B). This center pin 610 engages and compresses the elastomer element of the center conductor assembly. As shown in FIG. 6B, the probe uses UT-20 coax internally with a flat-faced pin attached to its center. The pin protrudes three mils from the flange face to compress the elastomer element of the center conductor assembly.

When two flanges are fastened together, the elastomer is compressed to a precise percentage of its uncompressed length. Compressing the elastomer increases its diameter equal to the diameter of the center conductor producing a constant impedance over its length. Unlike threaded outer conductor coaxial connector systems, the flange mount coaxial connector system flange provides a robust, mechanically stable mount which minimizes electrical performance changes with mechanical torque (torque sensitivity) due to heavy devices under test (DUTs) attached to the connector system.

The previous description of the preferred embodiments is provided to enable any person skilled in the art to make or use the embodiments of the present invention. While the invention has been particularly shown and described with reference to preferred embodiments thereof, it will be understood by those skilled in the art that various changes in form and details may be made therein without departing from the spirit and scope of the invention.

What is claimed is:

1. A coaxial high-frequency connector comprising:

a flange which comprises a first outer layer, a second outer layer, and an inner layer;

four bores passing through the flange for aligning the flange with guide pins of two mating interfaces;

a center bore in the flange, wherein the inner layer of the flange comprises, on each side, a relief surrounding the center bore;

a center conductor assembly captive in the center bore of the flange;

the center conductor assembly comprising a conductor element;

the center conductor assembly further comprising two annular polymer beads, each bead having a central bore which receives and engages the conductor element;

wherein the reliefs in the inner layer of the flange are configured to receive the annular polymer beads such that, when the first outer layer and a second outer layer are bonded to the inner layer, the beads are secured within the flange on either side of the inner layer and the conductor element is held captive in the center of the center bore of the flange; and an elastomer contact conductively bonded to each end of conductor element.

2. The connector of claim 1, wherein, said two annular polymer beads are made from polyimide.

3. The connector of claim 1, wherein the elastomer contacts are made from an electrically conductive deformable elastomer.

4. The connector of claim 1, wherein the flange is approximately 2 mm thick.

5. The connector of claim 1, in combination with a first mating interface of said two mating interfaces wherein the first mating interface comprises:

a flat surface;

two guide pins extending from the flat surface and configured to engage two of the four peripheral bores the flange to the mating interface; and a conductive center pin which protrudes above the flat surface, the conductive center pin positioned to contact and compress one said elastomer contact of the center conductor assembly.

6. The connector of claim 1, assembled in combination with said two mating interfaces wherein each of said two mating interface comprises:

a flat surface;

two guide pins extending from the flat surface and configured to engage a different two of the four bores passing through the flange for aligning the flange to the mating interface;

a conductive center pin which protrudes above the flat surface, the conductive center pin positioned to contact and compress one said elastomer contact of the center conductor assembly; and whereby, when assembled, the center pins of each mating interface are electrically coupled for the transmission of high-frequency signals through the elastomer contacts and conductor element.

7. The combination of claim 6, wherein one of said two mating interfaces is connected to a high-band module, and the other of said two mating interfaces is connected to a probe.

8. A coaxial high-frequency connector comprising:

a flange which comprises a first outer layer, a second outer layer, and an inner layer;

four peripheral bores passing through the flange;

a center bore passing through the flange;

a first relief on a first side of the inner layer surrounding the center bore and a second relief on a second side of the inner layer surrounding the center bore;

a conductor element having an elastomer contact conductively bonded to each end;

a first annular polymer bead and a second annular bead, each having a central bore;

wherein the first annular polymer bead is positioned in the first relief on the first side of the inner layer, and the second annular polymer bead is positioned in the second relief on the second side of the inner layer;

wherein the conductor element is positioned in the central bores of the first annular polymer bead and the second annular polymer bead;

wherein the first outer layer and second outer layer are bonded to the inner layer such that the first annular polymer bead is secured within the flange between the first outer layer and the inner layer on the first side of the inner layer, the second annular polymer bead is secured within the flange between the second outer layer and the inner layer on the second side of the inner layer, and the conductor element is held captive by the first and second polymer beads in the center of the center bore of the flange.

9. The coaxial high-frequency connector of claim 8 wherein the flange is approximately 2 mm thick and the first outer layer is bonded to the first side of the inner layer with epoxy and the second outer layer is bonded to the second side of the inner layer with epoxy.

10. The coaxial high-frequency connector of claim 8, wherein the flange is disc-shaped and approximately 2 mm thick.

11. The coaxial high-frequency connector of claim 8, wherein the first and second annular polymer beads are made from polyimide.

12. The coaxial high-frequency connector of claim 8 wherein:

the flange is disc-shaped and approximately 2 mm thick;

the first outer layer is bonded to the first side of the inner layer with epoxy and the second outer layer is bonded to the second side of the inner layer with epoxy; and the first and second annular polymer beads are made from polyimide.

13. A coaxial high-frequency connector assembly comprising:

a flange having four peripheral bores and a center bore passing through the flange and a a center conductor assembly, the center conductor assembly comprising a conductor element and an elastomer contact conductively bonded to each end of conductor element;

wherein the center conductor assembly further comprises two annular polymer beads, each bead having a central bore which receives and engages the conductor element and a peripheral edge which engages the center bore of the flange, whereby the conductor element is held captive in the center of the center bore of the flange;

a mating interface having a flat surface in contact with said flange and having two guide pins extending from the flat surface which pass through and engage two of said four peripheral bores and align the flange to the mating interface; and the mating interface having a conductive center pin which protrudes three mil above the flat surface, the conductive center pin contacting and compressing the elastomer contact at one end of the conductor element of the center conductor assembly.

14. The connector assembly of claim 13, wherein, the annular polymer beads are made from polyimide.

15. The connector assembly of claim 13, wherein the elastomer contacts are made from an electrically conductive deformable elastomer.

16. The connector assembly of claim 13, wherein the flange is approximately 2 mm thick.

17. The connector assembly of claim 13, wherein said mating interface is connected to a high-band module.

18. The connector assembly of claim 13, wherein said mating interface is connected to a probe.

19. The connector assembly of claim 13, wherein the flange comprises a first outer layer, a second outer layer, and an inner layer.

20. The connector assembly of claim 19, wherein the inner layer comprises on each side a relief surrounding the center bore, wherein the reliefs are configured to receive the peripheral edge of each bead such that when the first outer layer and a second outer layer are bonded to the inner layer, the beads are secured within the flange on either side of the inner layer.

* * * * *